US008973859B2

(12) United States Patent
Troncoso et al.

(10) Patent No.: US 8,973,859 B2
(45) Date of Patent: Mar. 10, 2015

(54) THREAD GUIDE FOR SEWING AND EMBROIDERY MACHINES

(76) Inventors: Eva G. Troncoso, Montrose, CO (US); Freddie Troncoso, Montrose, CO (US)

( * ) Notice: Subject to any disclaimer, the term of this patent is extended or adjusted under 35 U.S.C. 154(b) by 1021 days.

(21) Appl. No.: 12/951,000

(22) Filed: Nov. 20, 2010

(65) Prior Publication Data

US 2012/0125245 A1 May 24, 2012

(51) Int. Cl.

| | |
|---|---|
| ***B65H 49/26*** | (2006.01) |
| ***D05B 43/00*** | (2006.01) |
| ***B65H 57/26*** | (2006.01) |
| ***B65H 49/20*** | (2006.01) |
| ***B65H 49/32*** | (2006.01) |
| ***B65H 57/08*** | (2006.01) |
| ***D05C 11/00*** | (2006.01) |
| ***B65H 49/06*** | (2006.01) |
| ***B65H 57/18*** | (2006.01) |

(52) U.S. Cl.

CPC ..... *D05B 43/00* (2013.01); *B65H 57/26* (2013.01); *B65H 2701/31* (2013.01); *B65H 49/26* (2013.01); *B65H 49/205* (2013.01); *B65H 49/32* (2013.01); *B65H 57/08* (2013.01); *D05C 11/00* (2013.01); *B65H 49/06* (2013.01); *B65H 57/18* (2013.01)

USPC ..... 242/597.4; 242/129.72; 242/139; 242/597.7

(58) Field of Classification Search

CPC ..... D05C 11/00; D05B 43/00; B65H 49/18; B65H 49/205; B65H 49/26; B65H 49/32; B65H 57/18; B65H 57/26; B65H 57/08; B65H 49/06; B65H 2701/31; D04B 3/06

USPC ..... 242/140, 139, 129.72, 129.7, 566, 588, 242/593, 597, 597.1, 597.4, 597.6, 597.7, 242/597.8, 125–125.3

See application file for complete search history.

(56) References Cited

U.S. PATENT DOCUMENTS

| | | | | | |
|---|---|---|---|---|---|
| 1,648,437 | A * | 11/1927 | Anderson | ..... | 242/125.2 |
| 3,556,431 | A * | 1/1971 | Freitag et al. | ..... | 242/129 |
| 5,218,779 | A * | 6/1993 | Morgan et al. | ..... | 43/25 |
| 5,842,655 | A * | 12/1998 | McCarthy | ..... | 242/129 |
| 7,219,611 | B1 * | 5/2007 | Troncoso et al. | ..... | 112/78 |
| 2001/0054662 | A1 * | 12/2001 | Zwettler et al. | ..... | 242/345 |

* cited by examiner

*Primary Examiner* — William E Dondero

(57) ABSTRACT

A thread guide device for use with sewing and embroidering machines is adjustable to accommodate a variety of differently dimensioned thread spools or cones and is adapted for use with machines having a horizontally disposed thread spool support rod. The thread guide device includes a base having a support rod for supporting a spool or cone of thread on a rotor journalled for rotation on the support rod and dimensioned for insertion into the core of a spool or cone of thread. The rotor has a tapered end portion for accommodating spools or cones of different sizes. A wire loop thread guide secured to the base and mounted for selective lateral adjustment relative to the support rod has a first portion disposed within a slot of a slotted arm and a second portion provided with a coil wrapped around the slotted arm. A set screw secures a tapered retaining cap having a central axial aperture receiving the support rod to the support rod. A free floating thread retaining ring placed over an upper portion of a core of a thread spool or cone, allowing thread to be fed between the retaining ring and the core. A support ball mounted in an adjusted position along on the support rod by a set screw limits off-center movement of a thread spool or cone. The thread guide may be mounted on a ball having a cylindrical aperture slidably receiving the adjustment rod therethrough, such that the thread guide is selectively and independently adjustable in two perpendicular linear directions and also mounted for selective and independent adjustment around a first axis of rotation and a second perpendicular axis of rotation.

14 Claims, 3 Drawing Sheets

THREAD GUIDE FOR SEWING AND EMBROIDERY MACHINES

BACKGROUND OF THE INVENTION

1. Field of the Invention

The present invention relates to the field of sewing and embroidery machines, and more particularly pertains to a thread guide for use with such machines.

2. Description of the Related Technology

U.S. Pat. No. 5,842,655 which issued to V. McCarthy on Dec. 1, 1998 discloses a thread and yarn dispenser for supplying threaded material in different wound configurations to a user in the process of knitting or crocheting. The dispenser includes a base adapted to rest on a level surface and a circular support plate mounted for rotation on the base by a ball bearing. A cone shaped member having a coarse outer surface is centrally stationed in a vertical position on the support plate and has an elongated rod extending therethrough, such that the cone and the rod rotate with the support plate. The cone shaped member is adapted to engage a variety of wound spools of yarn or like threaded material and hold the spools securely on its coarse surface while rotating.

U.S. Pat. No. 7,219,611 which issued to Eva and Freddie Troncoso on May 22, 2007 discloses a sewing machine embroidery thread guide including a bent embroidery thread guide wire attached to a base mount releasably attached to a spool pin rod of an embroidery and sewing machine. An open spiral bent loop end of the upwardly bent wire adjusts to a position spaced slightly apart from and approximately centered on an embroidery thread spool mounted on the machine. A stepped base mount receives embroidery thread spools of different diameters.

The entire disclosure of each of the aforementioned patents is incorporated herein by this reference thereto.

Most larger thread spool cones are made with a variety of machine wound thread patterns which differ from manufacturer to manufacturer. Some thread cone cores are gradually tapered, while others have a cylindrical core. Both the larger tapered and cylindrical cores typically have a bell shaped flange located on the bottom portion of the lower cone opening. Presently, there are no unified dimensional standards which govern the dimensional criteria for manufacturing sewing and embroidery thread cones, thread cores, or bell flange openings.

As a result of the aforementioned dimensional differences, sewing and embroidering machine users often resort to use of a series of spacers or adapters to accommodate use of the various different available thread cones.

Manufacturers of sewing and embroidering machines in recent years have provided horizontal, rather than vertical, thread spool pin support rods, which further hinders usage of the wide variety of available thread cones, particularly those of a larger, and thus more economically desirable size.

SUMMARY OF THE INVENTION

The present invention discloses a thread guide device for use with sewing and embroidering machines which is adjustable to accommodate a variety of differently dimensioned thread spools or cones and is adapted for use with machines having a horizontally disposed thread spool support rod.

The thread guide device may include a base having a support rod secured to the base for supporting a spool or cone of thread on a rotor journalled for rotation on the support rod and dimensioned for insertion into the core of a spool or cone of thread. The rotor may include a tapered end portion for accommodating spools or cones of different sizes. A thread guide secured to the base and mounted for selective lateral adjustment relative to the support rod may take the form of a wire loop having a first portion disposed within a slot of a slotted arm and a second portion provided with a coil wrapped around the slotted arm.

A tapered retaining cap having a central axial aperture receiving the support rod, includes a fastener for securing the retaining cap to the support rod. The thread guide device may include a free floating thread retaining ring dimensioned for placement over an upper portion of a core of a thread spool or cone, whereby thread may be fed between the retaining ring and the core. The thread guide device may include a support ball received on the support rod for limiting lateral movement of a thread spool or cone, and a set screw for mounting the support ball in a selected adjusted position on the support rod. In one embodiment of the invention, a thread guide mounting member mounted for movement along an adjustment rod secured to the base is secured in a selected adjusted position by a fastener, wherein the thread guide is mounted for selective independent adjustment along two perpendicular directions. The thread guide mounting member may include a ball having a cylindrical aperture slidably receiving the adjustment rod therethrough, such that the thread guide is selectively and independently adjustable in two perpendicular linear directions and also mounted for selective and independent adjustment around a first axis of rotation and a second perpendicular axis of rotation.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
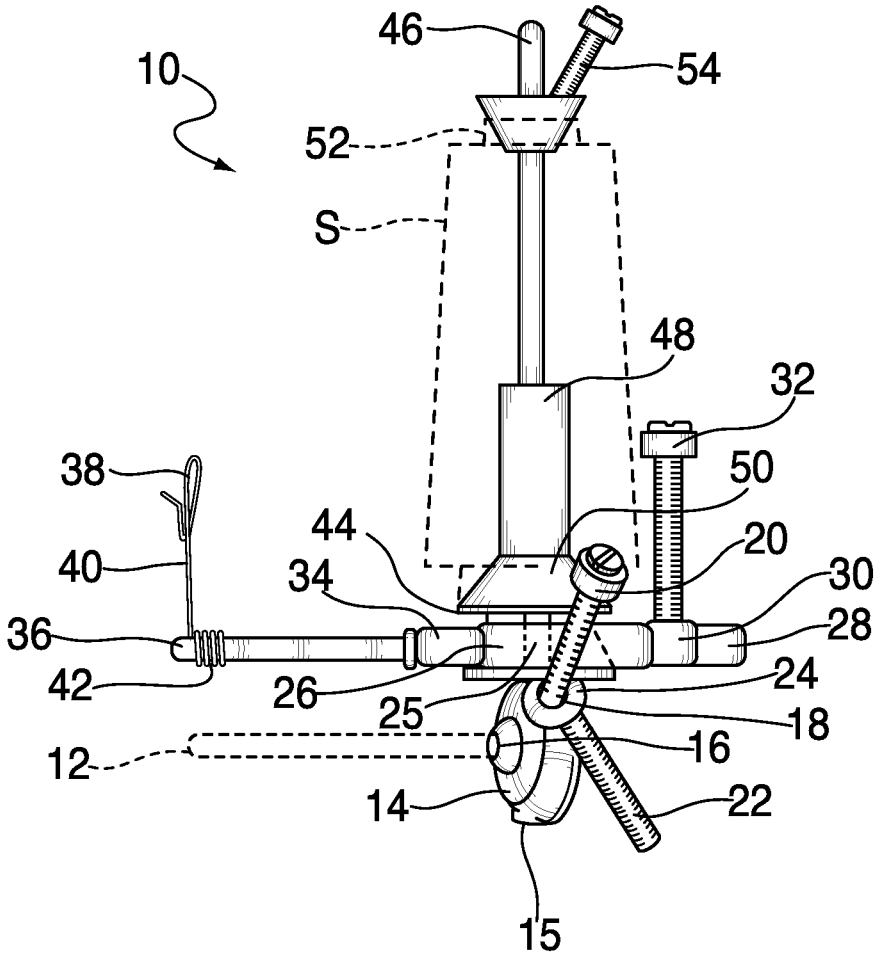
FIG. 1 is a side elevational view illustrating a thread guide device according to a first embodiment of the present invention.

With reference to the drawings, and in particular to FIG. 1, a thread guide device 10 according to a first preferred embodiment of the invention will now be described. The thread guide device 10 includes a generally circular mounting base 14 provided with a flattened bottom region 15 adapted to abut a surface of an embroidery or sewing machine to assist in the support and stabilization of the device 10. The mounting base 14 includes a central circular aperture 16 dimensioned and disposed to receive a horizontal spool pin 12 of the sewing machine. A threaded boss 18 receives a nylon set screw 20 which clamps the base 14 in position on the spindle pin 12. An optional elongated support brace 22 includes an enlarged washer portion 24 slip fit on the screw 20 to assist in supporting the base 14 on machines with slanted or angled upper thread and accessory compartments and facing.

An internally threaded vertical stub shaft 25 extends within a hollow, generally frustoconical vertical support base 26. The support base 26 includes a first laterally extending arm portion 28 having an internally threaded boss 30 which engages a nylon screw 32 which may be adjusted up or down for the purpose of tightening the unit onto the horizontal spool pin of the machine, thus facilitating the purpose of transforming a horizontal spool pin machine into a sewing embroidery machine capable of using a vertical spool pin which allows use of the larger and heavier type of thread spool cones. An oppositely extending second arm portion 34 of the support base 26 receives a slotted rod 36 in press fit relation within the arm 34. A wire loop thread guide 38 includes a straight shaft portion 40 disposed within the slot provided in the rod 36 and terminates in a spiral coil 42 in frictional engagement around the rod 36 such that the thread guide 38 may be adjusted by sliding along the length of the rod 36 and also by rotating the rod 36 within the arm 34. In each instance, the adjusted position is maintained by frictional engagement due to close fitting tolerances of the associated parts. A nylon nut 44 engages a lower threaded portion of a spool holder rod 46, which also engages the vertical stub shaft 25, securing the mounting base 14, the support base 26, and the spool holder rod 46 in fixed relation.

A support rotor 48 journalled for rotation on the spool holder rod 46 terminates at a lower upwardly tapering frustoconical portion 50 for the purpose of accommodating different size spools or cones of thread S thereon. In use, a spool or cone of thread S having a hollow interior portion is over the rotor 48 for rotation therewith. A downwardly tapering frustoconical retaining cap 52 includes a central cylindrical aperture which receives an upper end portion of the spool holder rod 46 therethrough. A nylon set screw 54 clamps the retaining cap 52 to the rod 46 and adjacent an upper end portion of the spool S, thus restraining the spool S against upward movement along the rod 46.

Figure 2:
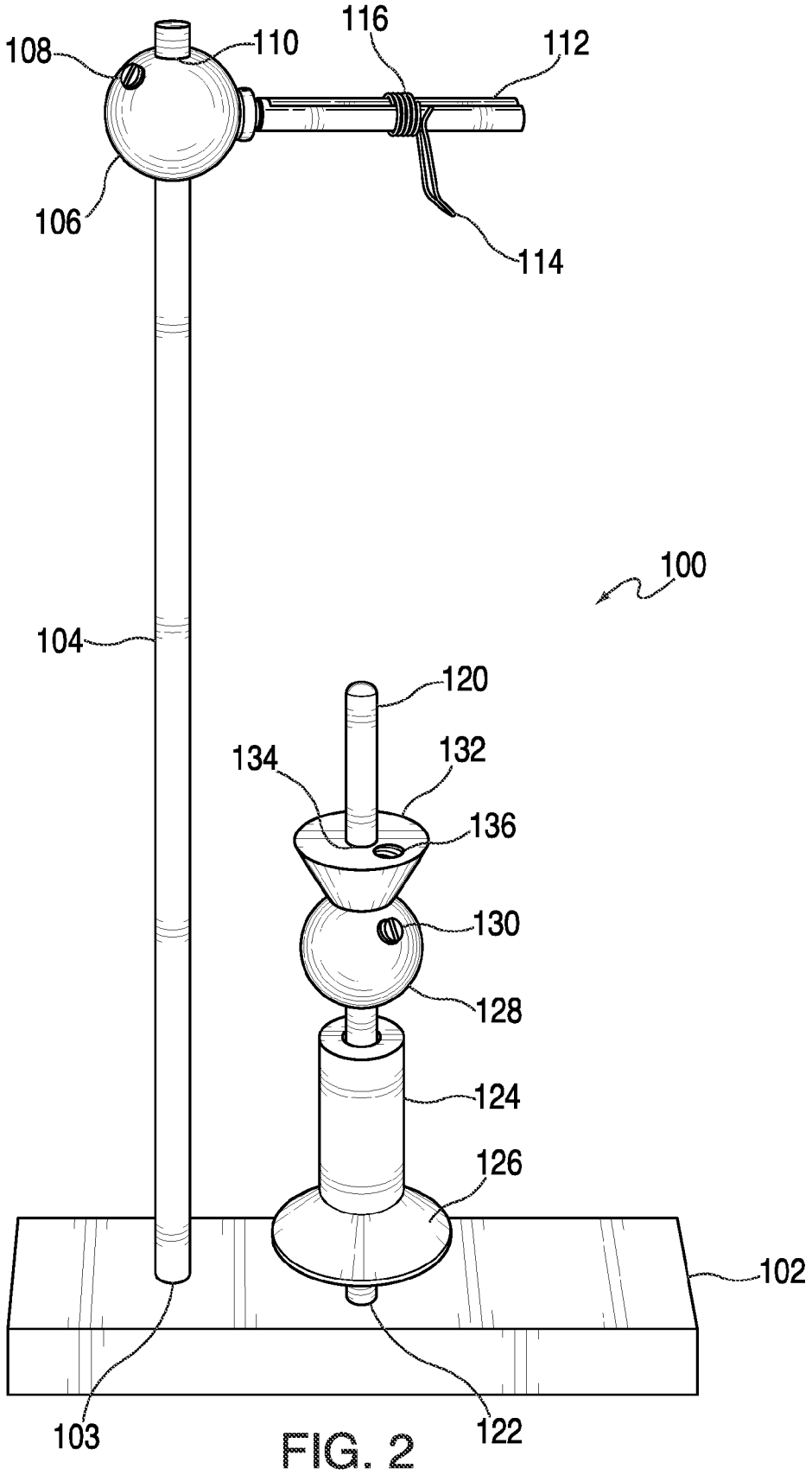
FIG. 2 is a perspective view illustrating a thread guide device according to a second embodiment of the invention.
Figure 3:
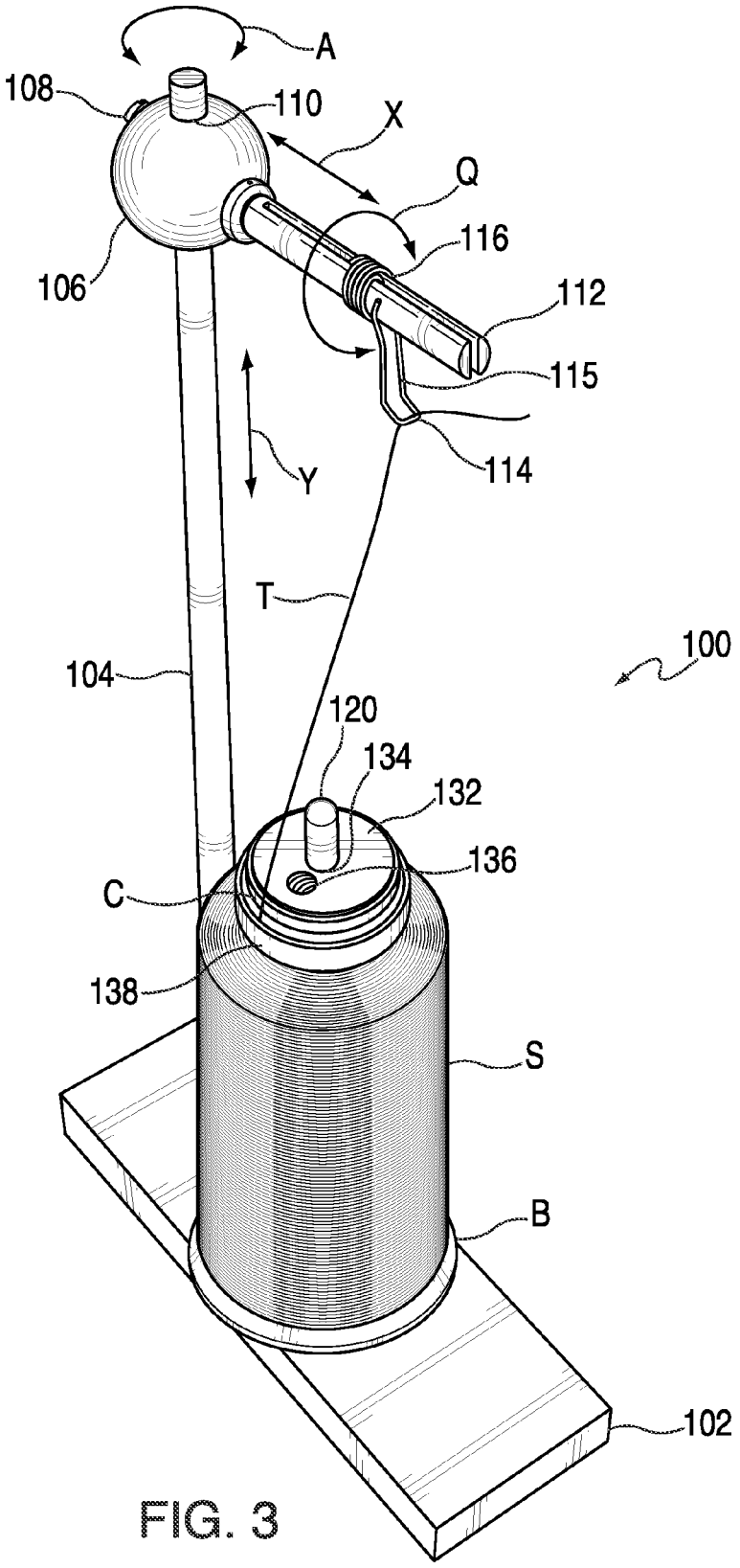
FIG. 3 is a perspective view illustrating the thread guide device of FIG. 2 with a thread spool mounted thereon.

With reference to FIGS. 2 and 3, a thread guide device 100 according to a second embodiment of the invention is adapted for use as a free standing unit, without attachment to a sewing or embroidering machine, and toward that end includes a rectangular base 102 provided with a vertically extending threaded aperture 103 which receives a lower threaded end portion of a vertical adjustment rod 104. A thread guide mounting member in the form of a ball 106 includes a central cylindrical aperture 110 dimensioned to slidably receive the rod 104 therethrough. A set screw 108 functions to clamp the ball member 106 at a selected vertical and rotationally adjusted position relative along the rod 104. A slotted rod 112 is received in press fit relation within an aperture provided in the ball member 106. A wire loop thread guide 114 includes a straight shaft portion 115 disposed within the slot provided in the rod 36 and terminates in a spiral coil 116 in frictional engagement around the rod 112 such that the thread guide 114 may be adjusted by sliding along the length of the rod 112 and also by rotating the rod 112 within the aperture in the ball member 106. In each instance, the adjusted position is maintained by frictional engagement due to close fitting tolerances of the associated parts. Thus, the thread guide 114 is selectively and independently adjustable in perpendicular X and Y directions and also selectively and independently rotationally adjustable about the axis of the rod 104 as indicated by arrow A and about the axis of the arm 112 as indicated by arrow Q.

A vertically disposed spool holder rod 120 includes a lower end portion received in a threaded aperture 122 provided in the base 102. A support rotor 124 journalled for rotation on the spool holder rod 120 terminates at a lower upwardly tapering frustoconical portion 126 for the purpose of accommodating different size spools or cones of thread S thereon. In use, a spool or cone of thread S having a hollow interior portion is placed over the rotor 124 for rotation therewith, with an internal surface of a bell shaped base B of the spool S engaging the frustoconical surface 126. A downwardly tapering frustoconical retaining cap 132 includes a central cylindrical aperture 134 which receives an upper end portion of the spool holder rod 120 therethrough. A set screw (not shown) received within a threaded aperture 136 clamps the retaining cap 132 to the rod 120 and adjacent and partially within an upper end portion of the core C of the spool S, thus restraining the spool S against upward movement along the rod 120.

A set screw 130 clamps a support ball 128 in a selected vertically adjusted position along the rod 120 for the purpose of limiting wobble and undue lateral movement or off-center movement caused by undesirable slack or misalignment of the spool S by bracing and stabilizing the spool by virtue of contact between the inner wall of the spool core. A free floating thread guide retainer ring 138 surrounds the upper end of the core C of the spool S and the free end of the thread T passes between the inner cylindrical surface of the ring 138 and the outer cylindrical surface of the core C, controlling unspooling of the thread T and eliminating potential snarling and tangling of the thread T, particularly during high speed sewing or embroidering operations. The end of the thread T passes through the loop wire guide 114 and then to the sewing or embroidering machine. One important feature of this embodiment of the invention is that it feeds thread from the top segment of a thread spool cone without requiring any rotation or gyrations of the thread spool cone.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A thread guide device, comprising:

a base;

a support rod for supporting a spool of thread extending from said base and secured thereto;

a rotor journalled for rotation on said support rod and dimensioned for insertion into a core of the spool of thread, said rotor including a tapered end portion for accommodating spools of different sizes;

a thread guide secured to said base and mounted for selective lateral adjustment relative to said support rod;

a support ball received on said support rod for limiting lateral movement of the spool of thread; and a set screw for mounting said support ball in a selected adjusted position on said support rod.

2. The thread guide device of claim 1, further comprising a slotted arm mounting said thread guide for lateral adjustment.

3. The thread guide device of claim 2, wherein said thread guide comprises a wire loop and includes a first portion disposed with the slot of said slotted arm and a second portion provided with a coil wrapped around said slotted arm.

4. The thread guide device of claim 1, further comprising a tapered retaining cap having a central axial aperture receiving said support rod, and further comprising a fastener for securing said retaining cap to said support rod.

5. The thread guide device of claim 1, further comprising a free floating thread retaining ring dimensioned for placement over an upper portion of the core of the spool of thread, whereby thread may be fed between said retaining ring and said core.

6. The thread guide device of claim 1, further comprising an adjustment rod secured to said base, a thread guide mounting member mounted for movement along said adjustment rod, and a fastener for securing said mounting member in a selected adjusted position along said adjustment rod, wherein said thread guide is mounted for selective independent adjustment along two perpendicular directions.

7. The thread guide device of claim 6, wherein said thread guide mounting member comprises a ball having a cylindrical aperture slidably receiving said adjustment rod therethrough.

8. A thread guide device, comprising, comprising:

a base;

a support rod for supporting a spool of thread extending from said base and secured thereto;

a rotor journalled for rotation on said support rod and dimensioned for insertion into a core of the spool of thread, said rotor including a tapered end portion for accommodating spools of different sizes;

a thread guide secured to said base;

a tapered retaining cap having a central axial aperture receiving said support rod;

a support ball received on said support rod for limiting off-center movement of a thread spool; and a fastener for mounting said support ball in a selected adjusted position on said support rod.

9. The thread guide device of claim 8, further comprising a slotted arm mounting said thread guide for lateral adjustment.

10. The thread guide device of claim 9, wherein said thread guide comprises a wire loop and includes a first portion disposed with the slot of said slotted arm and a second portion provided with a coil wrapped around said slotted arm.

11. The thread guide device of claim 8, further comprising a free floating thread retaining ring dimensioned for placement over an upper portion of the core of the spool of thread, whereby thread may be fed between said retaining ring and said core.

12. The thread guide device of claim 8, further comprising means for mounting said thread guide for selective and independent adjustment around at least one axis of rotation.

13. The thread guide device of claim 8, further comprising means for mounting said thread guide for selective and independent adjustment around a first and a second axis of rotation.

14. The thread guide device of claim 13, wherein said first axis of rotation and said second axis of rotation are substantially perpendicular.

* * * * *